United States Patent [19]

de Vaujany

[11] Patent Number: 4,750,312

[45] Date of Patent: Jun. 14, 1988

[54] METHOD OF AND APPARATUS FOR CAPPING BOTTLES

[75] Inventor: Robert de Vaujany, Genas, France

[73] Assignee: Manufacture Lyonnaise du Bouchage, Lyon, France

[21] Appl. No.: 17,188

[22] Filed: Feb. 19, 1987

[30] Foreign Application Priority Data

Feb. 19, 1986 [FR] France ..... 86 02763

[51] Int. Cl.[4] ..... B65B 7/28

[52] U.S. Cl. ..... 53/307; 53/329; 53/373

[58] Field of Search ..... 53/307, 314, 328, 329, 53/334, 340, 373, 478, 485, 488

[56] References Cited

U.S. PATENT DOCUMENTS

| | | | |
|---|---|---|---|
| 3,487,622 | 1/1970 | Mueller | 53/307 X |
| 3,509,682 | 5/1970 | Logemann | 53/307 X |
| 3,712,023 | 1/1973 | Bryan et al. | 53/307 |
| 3,908,340 | 9/1975 | Erhardt | 53/307 |
| 4,307,557 | 12/1981 | Shimizu et al. | 53/307 X |
| 4,625,498 | 12/1986 | Parsons | 53/329 X |

FOREIGN PATENT DOCUMENTS 3105911 11/1982 Fed. Rep. of Germany ..... 53/329

*Primary Examiner*—Robert L. Spruill
*Assistant Examiner*—Steven P. Weihrouch
*Attorney, Agent, or Firm*—Karl F. Ross; Herbert Dubno; Andrew Wilford

[57] ABSTRACT

An apparatus for fitting heat-sealed containers comprises a conveyor for displacing a succession of the containers in a normal direction of travel through a station and for arresting each of the containers momentarily in the station, a supply at the station holding a stack of caps, a grab for taking a cap off the stack and positioning it atop the container arrested in the station and a welding tool for tack welding the cap to the container in the station as the cap is being positioned on the container and while it is still held by the grab, and a device downstream of the station for heat shrinking the caps on the bottles. The welding tool and grab are practically the same device and work very closely together. Thus there is no time during which the cap is not being positively held. Before the grab releases it, it is tack-welded to the bottle.

8 Claims, 2 Drawing Sheets

METHOD OF AND APPARATUS FOR CAPPING BOTTLES

FIELD OF THE INVENTION

The present invention relates to a method of and apparatus for applying caps or covers to a succession of containers and bottles. More particularly, this invention concerns the use of heat-sealed caps.

BACKGROUND OF THE INVENTION

Heat-sealed caps have the advantage of being very cheap, sealing very tightly, and providing a clear indication of tampering. The standard procedure for capping a bottle is to move a succession of the bottles through a station where the caps are set atop them, and then to a heat sealer where the caps are sealed under application of pressure.

In the upstream station where the caps are set on the bottles, it is standard to stack the caps, which are thin foils or films, in a magazine or supply whose bottom is open. At this supply, a grab pulls a cap off the bottom of the stack and sets it accurately atop a bottle, normally while same travels through the station.

In the heat-sealing device, a pressure is applied to the top of the bottle and simultaneously, to the heating of the caps, those being thus heat sealed to the rims of the containers.

The caps are formed of a suitable heat-sealable material or have a suitable heat sensitive coating which is operative when heated to effect a seal to the rims of the containers.

The main problem with such devices is that the cap shifts or falls off the bottles before they can be heat sealed in place. The caps are typically very light and fit fairly loosely on the bottles, so that keeping them in position is not simple. On the other hand, if the cap is lost the package being made is normally ruined and must be rejected.

In U.S. Pat. No. 3,908,340, the caps are displaced continuously, that is without stopping through the station where the caps are emplaced and a device is used to tack-weld the caps on, immediately after they are positioned. Such an arrangement represents an improvement on the known systems, but nonetheless, still produces excessive rejects where the cap has shifted or been lost.

Furthermore, it is not possible to effect the heat sealing at the supply, since this heat sealing implies the application of a pressure which is not compatible with the structure of the grab which effects a 180° rotation.

OBJECTS OF THE INVENTION

It is, therefore, an object of the present invention to provide an improved method of and apparatus for applying heat-sealed caps to containers.

Another object is the provision of such a method of and apparatus for applying heat-sealed caps to containers which overcomes the above-given disadvantages that is, which ensures that the caps cannot move from the very instant they are fitted to the containers until they are solidly heat-sealed in place.

SUMMARY OF THE INVENTION

This is achieved, according to the invention, in a system wherein the container is displaced on a conveyor through a station where a cap is set in place atop it and hence to another station where the cap is heat sealed onto the bottle. According to the invention, the cap is tack-welded to the container at substantially the same time as the cap is set on the container and while it is still being held by the grab that takes the cap from a supply and sets it atop the bottle.

Thus with the system of this invention, there is no time during which the ca is not being positively held. Before the grab releases it, it is tack-welded to the bottle. There is therefore no substantial possibility of it working loose or shifting before it is heat sealed tightly in place.

According to another feature of this invention, the cap is set on the annular mouth of the container and is tack-welded at two separate offset locations. In addition, a succession of such containers are moved in steps through the capping/tacking station, a stack of such caps are held above the conveyor in the station, and the lowermost cap from the stack is removed in substantially the same movement as is used to set it on and tack it to the bottle.

The apparatus of this invention, therefore, comprises a conveyor for displacing a succession of the containers in a normal direction of travel through a station and for arresting each of the containers momentarily in the station, a supply at the station holding a stack of caps, a grab for taking a cap off the stack and positioning it atop the container arrested in the station and a welding tool for tack welding the cap to the container in the station as the cap is being positioned on the container and while it is still held by the grab, and a device downstream of the station for heat sealing the caps on the bottles. The welding tool and grab are practically the same device and work very closely together.

In accordance with another feature of this invention, the grab moves about an axis between an upper end position engaging the lowermost cap in the stack and a lower end position holding the cap down on the mouth of the container arrested in the station and the welding tool also moves about the axis and is spaced from the axis about the same as the grab. Furthermore, the welding tool moves about the axis between a lower position engaging the cap atop the container in the station and an upper position well below the grab in its upper position. The welding tool has a pair of abutments spaced angularly relative to the axis and the grab engages one of the abutments in the upper position and the other abutment in the lower position. The grab moves through an intermediate position generally midway between its upper and lower positions and engages the other abutment in this intermediate position and remains in contact therewith while moving between the intermediate position and the lower position. Finally, the welding tool is bifurcated and has a pair of sides flanking the abutments and forming respective welding edges. The welding tool is provided with a heater.

The edges of the tool of this invention are elongated and engage spaced locations on the cap atop the container in the station. In addition the grab is a suction cup.

BRIEF DESCRIPTION OF THE DRAWING

The above and other features and advantages will become more readily apparent from the following, reference being made to the accompanying drawing in which.

SPECIFIC DESCRIPTION

Figure 1:
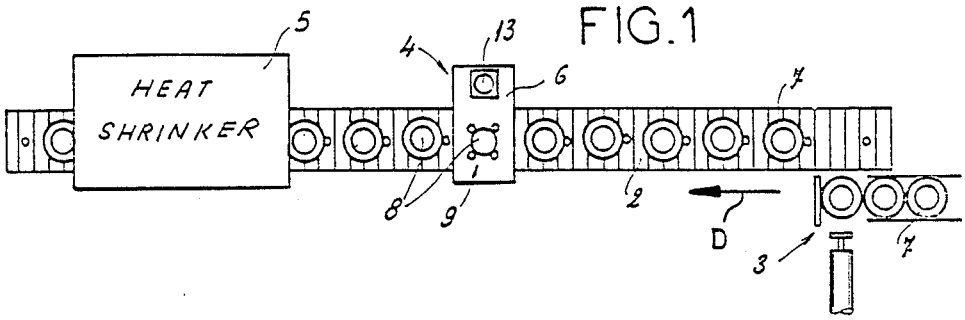
FIG. 1 is a small-scale and partly diagrammatic top view of a capping machine according to this invention.

As seen in FIG. 1 a standard belt-type conveyor 2 steps containers 7, hereinafter referred to as bottles, in a horizontal transport direction D. The containers are loaded at 3 onto the upstream end of the conveyor and are passed in the direction D through an intermediate station 4 where caps 8 are fitted and tacked to the containers 7. Further downstream, the containers 7 with their caps pass into a heat-sealing device 5 which pulls the normally plastic caps into tight engagement with the mouths of the containers 7.

Figure 2:
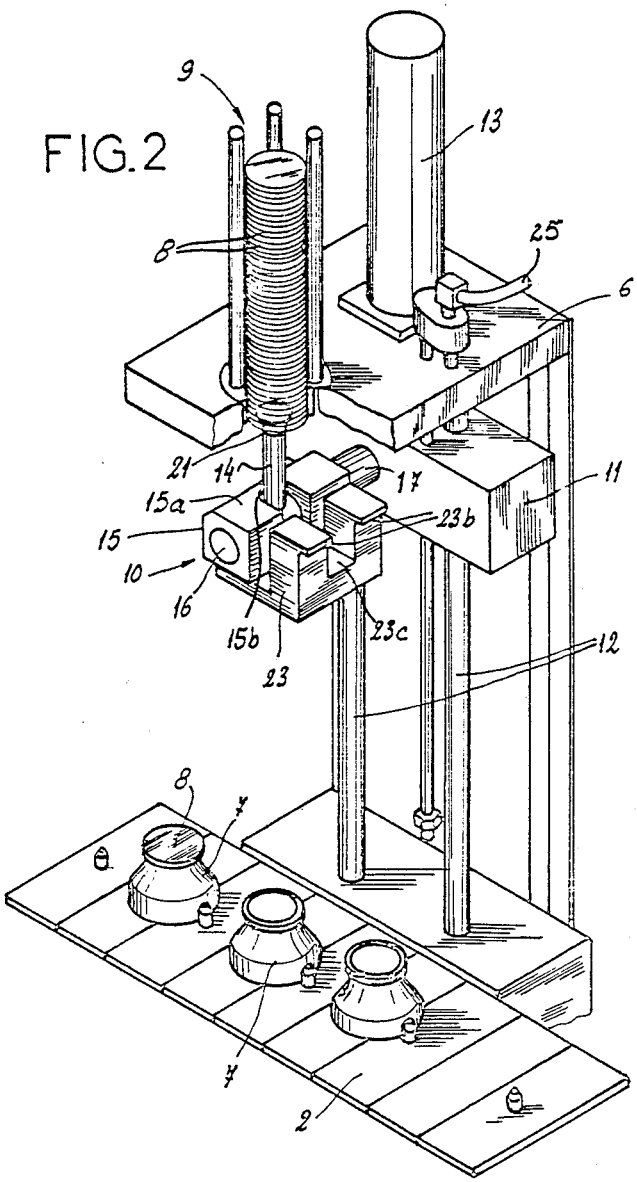
FIG. 2 is a larger scale perspective view of the device for setting and tacking the caps on the bottles.
Figure 3:
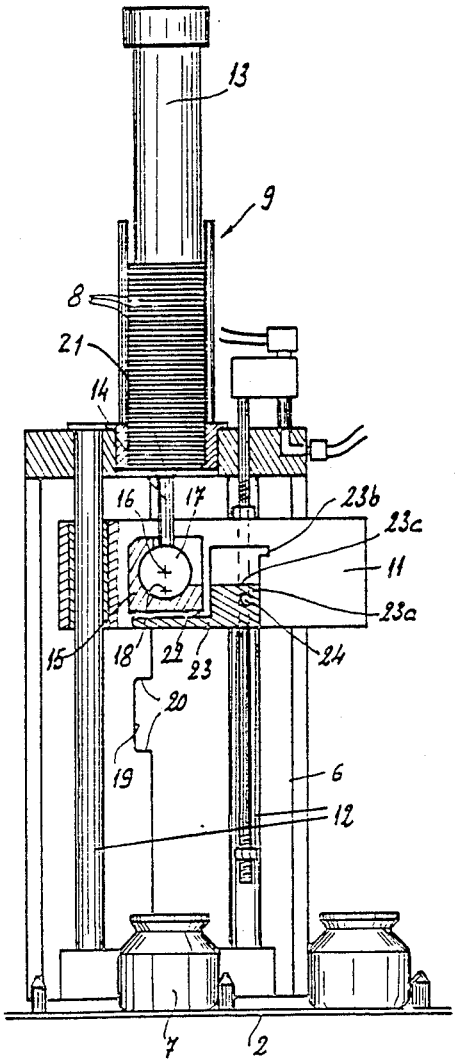
FIGS. 3 and 4 are side views of the FIG. 3 apparatus with the grab and welding tool in the fully up and fully down position, respectively.
Figure 4:
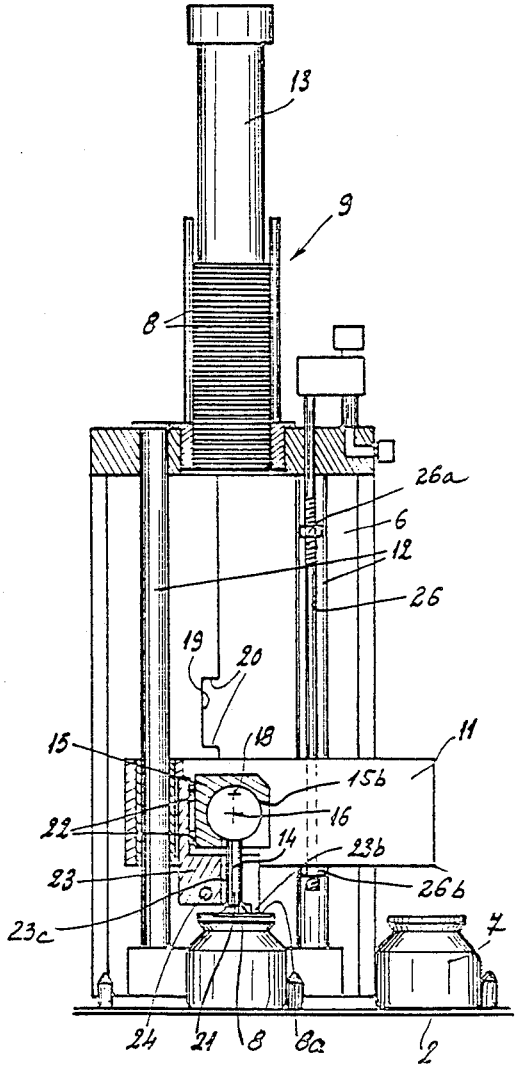

FIGS. 2 through 4 show the apparatus that sets on and tacks the caps 8 to the bottles 7 in the station 4. This apparatus has a stationary upright frame 6 supporting a holder 9, in which a stack of the disk-like caps 8 are held, the lower end of the holder 9 being open but being slightly smaller than the caps 8 so that while they can be pulled forcibly out the bottom of this holder 9 they do not fall through of their own weight. A pair of upright guide rods 12 carry a main support 11 that can be moved between an up position shown in FIGS. 2 and 3 and a down position shown in FIG. 4. A stationary rod 26 carrying upper and lower stop nuts 26*a* and 26*b* defines these end positions for the support 11.

A shaft 17 extends along and is rotatable about a horizontal axis 16 perpendicular to the direction D from the support 11. An arm 14 extends perpendicularly from this shaft 17 and carries at its outer end a suction cup 21 from which air is periodically aspirated by a vacuum source 25. In addition, this shaft 17 has at its rear end a follower 18 whose axis of rotation 18 is eccentric relative to the shaft 17 and that coacts with stops 20 of a cam 19 formed on the frame 6 to pivot the arm 14 through 180° as the support 11 moves between its end positions. The follower is biased by an unillustrated spring against the cam 19.

As shown in FIGS. 3 and 4, the axis 18 of the follower is below the axis 16 when the support 11 is in the upper position and is above this axis 16 when the support 11 is in the lower position.

A body 15 is rotatable on the shaft 17 about its axis 16 and carries via insulating washers 22 a pusher body 23 formed with a lateral projection 23*a* having a pair of pusher edges 23*b* flanking a groove 23*c* in which the rod 14 can fit. As shown in FIGS. 3 and 4, the edges 23*b* are directed horizontally in the upper position and vertically in the lower position. The body 23 is provided with an electric heating capsule 24 which maintains it and the two aligned edges 23*b* at a temperature sufficient to wedge the caps 8. The spacing from the edges 23*b* to the axis 16 is equal to or slightly less than the spacing from the outer face of the suction cup 21 to this axis 16. In addition, the bodies 15 and 23 define a pair of limit surfaces 15*b* and 23*c* whose purpose will be described below.

The apparatus described above operates as follows:

Assuming the support 11 is in its upper position shown at FIG. 3, with the rod 14 extending vertically and abutting the surface 15*b*. The cup 21 presses against the lowermost cap 8 in the holder 9 and this lowermost cap 8 sticks tightly to the suction cup 21, through which air is being drawn.

When the actuator 13 pushes the support 11 down, the lowermost cap 8 is pulled out of the holder 9. As the follower 18 passes the upper cam end 20, the shaft 17 and the rod 14 will rotate through 90°, the rod 14 coming into abutment with the surface 23*c*. Further downward, displacement will cause, as the follower 18 engages the lower cam end 20, another 90° rotation of the rod 14, as well as 90° rotation of the body 23, this one being rotated by the rod 14 abutting against the surface 23*c*.

Thus when the support 11 is pushed down, the rod 14 rotates through 180° whereas the body 23 only rotates through 90°.

At the end of this movement, the cap 8 on the cup will end-up directed downward and lying immediately below the welding edges 23*b*, and will arrive straight down into position atop the bottle 7 arrested in the station 4. The edges 23*b* press down against the cap 8 and tack-weld it to the mouth of the bottle 8 at two separate locations. Meanwhile the suction to the cup 21 is cut.

Reversely, when the support 11 is raised from its lower position to its upper position, the above-detailed steps are repeated in reverse, the shaft 17 and the rod 14 effecting two successive 90° rotations upwardly. First the shaft 17 and the rod 14 effect a first rotation through 90° and reach their intermediate position, as the follower 18 engages the lower cam end 20, the body 23 remaining downward. Secondly, as the follower 18 engages the upper cam end, the shaft 17 and the rod 14 effect a second 90° rotation upward, the body 23 being simultaneously rotated through 90° by the rod 14 engaging its abutment surface 15*b*.

When the support 11 is in its upper position, the cycle can start all over again.

At no time are one of the caps 8 released. Either it is held by the suction cup or pressed by the tool 15, 23 down against the bottle or it is tack-welded to this bottle 7. Either way, there is virtually no chance of it slipping or coming off.

It should also be noted that the elongated form of the edges 23*b* permits a better wedging, since this one is not punctual, and also permits an adaptation of the device to several sizes of caps.

I claim:

1. An apparatus for capping bottles, the apparatus comprising:

transport means including a conveyor for displacing a succession of the bottles in a normal direction of travel through a station and for arresting each of the bottles momentarily in the station;

a supply at the station holding a stack of caps;

means including a grab movable between an upper position engaging the lowermost cap in the stack and a lower position holding the cap down on the mouth of the bottle arrested in the station and through an intermediate position spaced from the caps in the supply and from the bottle in the station for taking a cap off the stack in the upper position and positioning it in the lower position atop the bottle arrested in the station and a welding tool movable with the grab only between the intermediate and lower positions for tack welding the cap to the bottle in the station as the cap is being positioned on the bottle and while it is still held by the grab; and means downstream of the station for heat shrinking the caps on the bottles.

2. The apparatus defined in claim 1 wherein the grab moves above an axis between its upper end position engaging the lowermost cap in the stack and its lower end position holding the cap down on the mouth of the bottle arrested in the station, the welding tool also moving about the axis on displacement between the intermediate and lower positions and being spaced from the axis about the same as the grab.

3. The apparatus defined in claim 1 wherein the grab is a suction cup.

4. The apparatus defined in claim 1, further comprising stop means preventing the welding tool from moving with the grab above the intermediate position into close proximity with the caps in the supply.

5. An apparatus for capping bottles, the apparatus comprising:

transport means including a conveyor for displacing a succession of the bottles in a normal direction of travel through a station and for arresting each of the bottles momentarily in the station;

a supply at the station holding a stack of caps;

means including a grab movable about an axis between an upper end position engaging the lowermost cap in the stack and a lower end position holding the cap down on the mouth of the bottle arrested in the station for taking a cap off the stack and positioning it atop the bottle arrested in the station and a welding tool also movable about the axis and spaced from the axis about the same as the grab for tack welding the cap to the bottle in the station as the cap is being positioned on the bottle and while it is still held by the grab, the welding tool having a pair of abutments spaced angularly relative to the axis, the grab engaging one of the abutments in the upper position and the other abutment in the lower position; and means downstream of the station for heat shrinking the caps on the bottles.

6. The apparatus defined in claim 5 wherein the grab moves through an intermediate position generally midway between its upper and lower positions and engages the other abutment in this intermediate position and remains in contact therewith while moving between the intermediate position and the lower position.

7. The apparatus defined in claim 6 wherein the welding tool is bifurcated and has a pair of sides flanking the abutments and forming respective welding edges, the welding tool being provided with a heater.

8. The apparatus defined in claim 7 wherein the edges are elongated and engage spaced locations on the cap atop the container in the station.

* * * * *